United States Patent [19]

Mochizuki et al.

[11] Patent Number: 4,714,635

[45] Date of Patent: Dec. 22, 1987

[54] AUTOMATIC SPRAYING METHOD

[75] Inventors: Takeshi Mochizuki; Katsumasa Iwasawa; Ikuya Shiraishi, all of Kanagawa; Kazuki Terafuji, Hiroshima, all of Japan

[73] Assignee: Iwata Air Compressor Mfg. Co., Ltd., Tokyo, Japan

[21] Appl. No.: 900,626

[22] Filed: Aug. 26, 1986

[30] Foreign Application Priority Data

Sep. 4, 1985 [JP] Japan ..... 60-195352

[51] Int. Cl.[4] ..... B05D 1/02

[52] U.S. Cl. ..... 427/421; 118/300; 427/9; 427/10; 239/11

[58] Field of Search ..... 118/300; 427/421, 9, 427/10; 239/1, 11

[56] References Cited

U.S. PATENT DOCUMENTS 3,027,273 3/1962 Sacks ..... 427/10

3,260,616 7/1966 Brewer ..... 427/421

FOREIGN PATENT DOCUMENTS 555916 4/1977 U.S.S.R. ..... 118/300

*Primary Examiner*—Shrive P. Beck

*Assistant Examiner*—Alain Bashore

*Attorney, Agent, or Firm*—Wenderoth, Lind & Ponack

[57] ABSTRACT

An automatic spraying method wherein the amount of displacement of a valve member is calculated from data representing a particular spray distance by means of a microcomputer, and the valve member is activated on the basis of the displacement amount thus obtained. A curve which represents the relationship between the valve member displacement and the amount of a fluid which is to be jetted out is experimentally obtained in advance, and this curve is approximated by a plurality of straight lines or parabolas. The slopes or average slopes of these lines or curves are obtained, and the ratio between the respective slopes of the sections which are adjacent to each other is calculated. Trial spraying is carried out at two different spray distances within a range of valve member displacement amounts so as to provide a desired coating, and the relationship between the spray distance and the valve member displacement amount which provides similar coatings is obtained at two points. An equation in the section is determined by the microcomputer on the basis of data concerning the two points and data which determines whether the section is a straight line or a parabola. An equation in an adjacent section is determined from the equation already obtained and the slope ratio, and these equations are stored in a memory, whereby the valve member displacement for input data representing a particular spray distance can be calculated on the basis of the stored equations.

1 Claim, 4 Drawing Figures

AUTOMATIC SPRAYING METHOD

BACKGROUND OF THE INVENTION

1. Field of the Invention:

The present invention relates to an automatic spraying method wherein the distance between a spray apparatus and an object is continuously detected, and the position of a valve member of a control valve means for controlling the flow rate of a fluid to be jetted out is varied in accordance with the detected distance.

2. Description of the Related Art:

A means has already been known wherein the position of a valve member of a control valve means for controlling the flow rate of a fluid to be jetted out is automatically varied in accordance with the distance between a spray apparatus and an object (said distance being hereinafter referred to as "spray distance") in order to maintain a desired coating thickness (or a desired spray pattern in addition thereto) even when the spray distance changes. However, since the spray distance and the amount of displacement of the valve member are not linearly related to each other, it has heretofore been necessary to obtain a complicated curve representing the relationship therebetween by carrying out experiments in advance, and then to program the obtained relationship into a microcomputer so that, when data representing a particular spray distance is input, it is possible to obtain data representing the amount of displacement of the valve member which corresponds to the spray distance input. Such experimentation and programming take an unfavorably long time, and the microcomputer needs to have an inconveniently large capacity.

SUMMARY OF THE INVENTION

In view of the above-described circumstances, it is a primary object of the present invention to provide an automatic spraying method which enables the relationship between the spray distance and the displacement amount of the valve member to be determined through a relatively simple functional calculation without the need to obtain said relationship by actually carrying out spraying, and which permits spraying to be automatically conducted under predetermined conditions in accordance with the determined relationship.

To this end, the present invention provides an automatic spraying method wherein a curve representing the relationship between the flow rate of a fluid which is to be jetted out and the amount of displacement of a valve member (this curve being hereinafter referred to as a "first curve") is divided into a plurality of sections, the curve in each section being approximated by a straight line or a parabola, and in order to obtain a curve representing the relationship between the spray distance and the valve member displacement amount (this curve being hereinafter referred to as a "second curve"), such assumption is made that a section which is a straight line in the first curve is also a straight line in the second curve and a section which is a parabola in the first curve is also a parabola in the second curve. Trial spraying is carried out at two different spray distances within a range in one section, thereby determining the equation of the straight line or parabola of that section. With respect to another section of the second curve, the ratio between the slope of one section and the slope of another section in the first curve is similarly applied to the corresponding sections of the second curve, thereby determining the equation of the straight line or parabola of a second section in the second curve.

BRIEF DESCRIPTION OF THE DRAWINGS

The above and other objects, features and advantages of the present invention will become more apparent from the following description of the preferred embodiment thereof, taken in conjunction with the accompanying drawings, in which.

DESCRIPTION OF THE PREFERRED EMBODIMENT

The present invention will be described hereinunder in detail with reference to the accompanying drawings.

Figure 1:
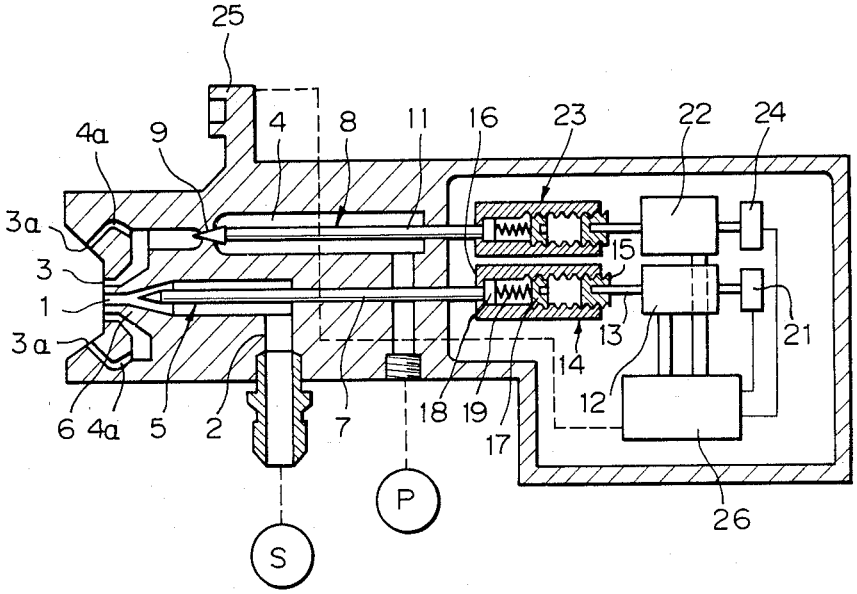
FIG. 1 is a vertical sectional view of a paint spray apparatus employed to carry out the method according to the present invention.

Referring first to FIG. 1, which is a vertical sectional view of a paint spray apparatus employed to carry out the method according to the present invention, the apparatus has a paint nozzle 1 and a paint supply passage 2 which is communicated with the nozzle 1. The supply passage 2 is communicated with a paint supply source S. An air nozzle 3 is formed around the paint nozzle 1, and a pressurized air supply passage 4 is formed such as to be communicated with the air nozzle 3. An air compressor P is connected to the air supply passage 4. Spray pattern adjusting air passages **4*a* are branched off from the air supply passage 4 in such a manner that the air passages 4*a* extend to spray pattern adjusting air nozzles 3*a*. The spray pattern can be varied in accordance with the pressure of the air jetted out from these air nozzle 3*a*. A flow rate control valve means 5 for controlling the flow rate of paint is provided in the paint supply passage 2. The control valve means 5 has a valve seat 6 formed in close proximity to the paint nozzle 1, and a valve member 7 provided in such a manner as to be movable toward and away from the valve seat 6. Similarly, a flow rate control valve means 8 for controlling the flow rate of air is provided in the air supply passage 4. This control valve means 8 has a valve seat 9 and a valve member 11**.

The flow rate control valve means 5 further has a servomotor 12, and an output shaft 13 of the motor 12 and the valve member 7 are connected through a transmission means 14. This transmission means 14 includes a screw member 15 keyed to the output shaft 13, and a casing 16 having an internal thread engaged with an external thread formed on the screw member 15. The casing 16 is allowed to move in the longitudinal direction thereof but is prevented from rotating. Accordingly, the casing 16 is displaced in the axial direction of the output shaft 13 in response to the rotation of the shaft 13. A setscrew 17 is screwed into the casing 16, and a compression spring 19 is interposed between the setscrew 17 and an enlarged head portion 18 formed at the rear end of the valve member 7 accommodated inside the casing 16. Accordingly, when the motor 12 further rotates in the valve closing direction after the valve member 7 has come into contact with the valve seat 6, the resistance against the motor 12 does not increase suddenly, but the casing 16 moves axially against the force applied by the spring 19, thus allowing the resistance against the motor 12 to increase gradually. The output shaft 13 of the motor 12 is further connected to a position detecting means 21 defined by a combination of an encoder which generates a pulse every time the output shaft 13 turns a predetermined rotational angle, and a counter adapted to count the number of pulses generated from the encoder.

The other flow rate control valve means 8 also has a servomotor 22, a transmission means 23 and a position detecting means 24. The arrangements and functions of these members or means are the same as those of the servomotor 12, the transmission means 14 and the position detecting means 21, and description thereof is therefore omitted.

The spray apparatus further has an ultrasonic distance measuring means 25 with a known arrangement. The distance measuring means 25 is adapted to input data concerning the distance from an object into a microcomputer incorporated in a control means 26. The microcomputer is adapted to determine the amount by which the valve member 7 is to be displaced from the valve closing position on the basis of the distance data input and in accordance with a predetermined program, and to further determine the amount by which the valve member 7 is to be moved by making comparison between the determined amount of displacement and the present position data delivered from the position detecting means 21. The control means 26 activates the motor 12 in response to a command signal which gives the determined amount of movement of the valve member 7.

The following is a description of the procedure for storing the relationship between the spray distance and the displacement amount of each of the valve members in the microcomputer.

Figure 2:
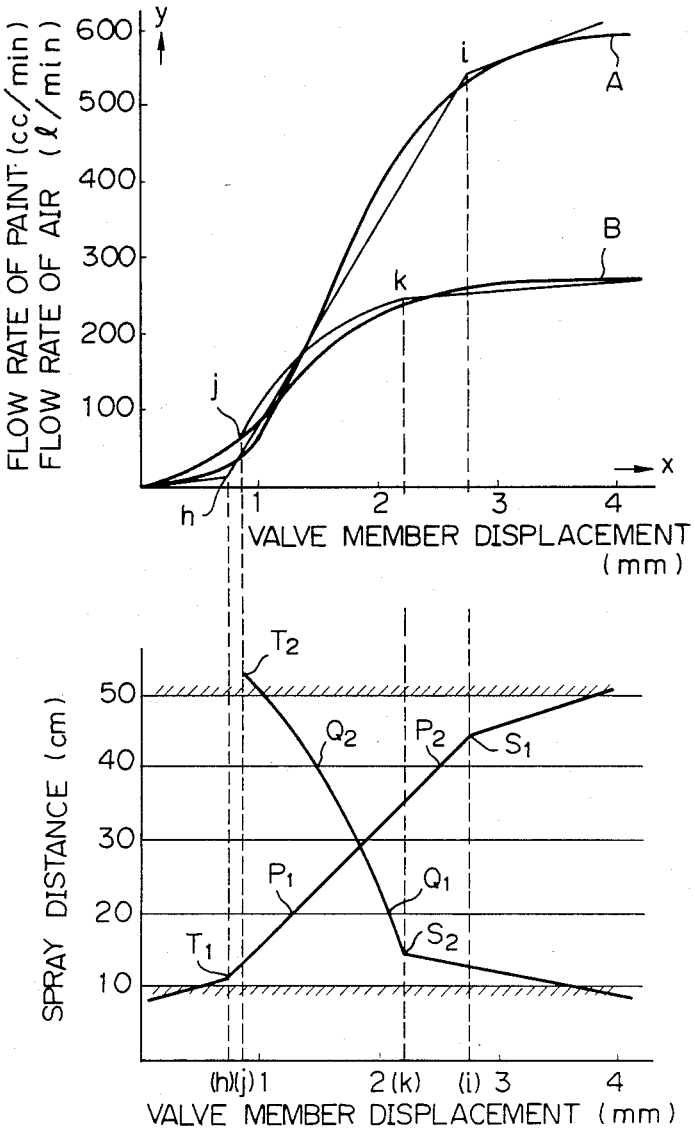
FIG. 2 is a graph showing the relationship between curves each representing the relationship between the amount of displacement of each of the valve members in the apparatus shown in FIG. 1 and the flow rate of a related fluid which is to be jetted out, and curves representing the relationship between the amount of displacement of each valve member and the spray distance.

The graph shown in the upper part of FIG. 2 represents the relationship between the flow rate of each fluid jetted out and the displacement amount of the corresponding valve member. The curves shown in the graph are obtained in advance by actually carrying out spraying and plotting the items of data thus obtained. It should be noted that these curves are generally obtained for each type of spray apparatus, and are included in a specification attached to each individual spray apparatus. Therefore, the preparation of the curves does not constitute any additional task. The curves in the graph shown in the upper part of FIG. 2 will hereinafter be referred to as "first curves" for paint and air, respectively, for the convenience of explanation.

According to the present invention, each of the first curves is approximated by straight lines and/or parabolas. In this embodiment, the first curve A for paint is approximated by three straight lines intersecting one another at boundary points "h" and "i". On the other hand, the first curve B for air is divided into two sections which intersect each other at a point "k", and the section of the curve B on the right-hand side of the point "k" is approximated by a straight line, while the section of the curve B on the left-hand side of the point "k" is approximated by a parabola which is represented by the equation, $x=ay^2+b$. The point "j" is defined by the lower limit of a range within which the curve B can be approximated by a parabola in the embodiment. However, when the displacement amount of the valve member which corresponds to the lower limit of a range within which normal spraying can be effected is located at a position to the right of the above-described point, this limit position may be employed as the point "j". In any case, the position of "j" is determined so that the curve between the points "j" and "k" can be approximated by a parabola.

After the graph has been constructed as described above, x-coordinates (displacement amounts of the valve members) which respectively correspond to the points "h", "i", "j" and "k", the slope of each of the straight lines, and an average slope of the curve between the points "j" and "k" are obtained on the graph. As to the average slope of the curve between the points "j" and "k", it is possible to employ either the slope of a straight line that connects the points "j" and "k", or the slope of a tangent of the curve at a middle point between the points "j" and "k". These values thus obtained are stored in the microcomputer, and data concerning the fact that each section is a straight line or a parabola is further stored in the microcomputer.

Figure 3:
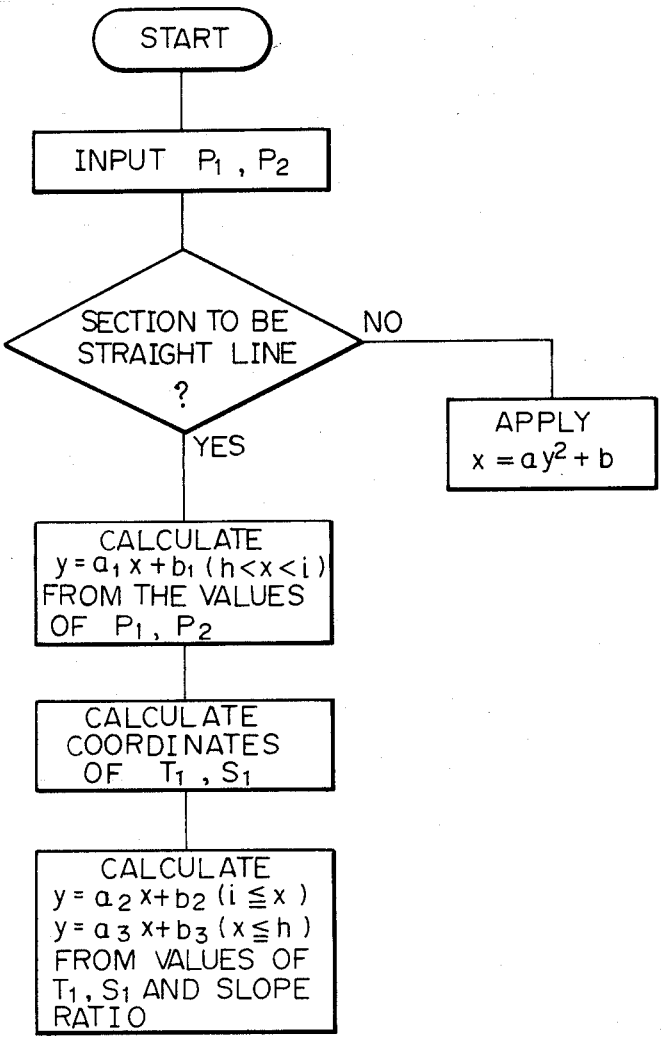
FIG. 3 is a flow chart showing the procedure for obtaining an equation representing the relationship between the displacement amount of the valve member and the spray distance with respect to paint.

With the above-described data items stored in advance, a procedure is started in which an equation representing the relationship between the spray distance and the valve member displacement amount is obtained by and stored in the microcomputer. This procedure will be explained below with reference to the flow charts shown in FIGS. 3 and 4 and the graph shown in the lower part of FIG. 2. The graph shown in the lower part of FIG. 2 is provided in order to graphically illustrate the procedure so that it is possible to readily understand the principle of the operation of the microcomputer.

Description will first be made with respect to paint. Trial spraying is first carried out at two different spray distances within a range which is included in a preselected section, e.g., a section between the points "h" and "i", and valve member displacement amounts for these two spray distances are determined so that the same coating thickness and the same spray pattern are obtained for these two spray distances. As shown in the graph in the lower part of FIG. 2, trial spraying is carried out at spray distances of 20 cm and 40 cm, and valve member displacement amounts are obtained for these spray distances. The relationship between the spray distance and the valve member displacement amount in this case is represented by $P_1$ and $P_2$ in the graph. Coordinate values which respectively correspond to $P_1$ and $P_2$ are input to the microcomputer. The coordinate values may be manually input by an operator through an input means provided independently, or may be automatically input on the basis of the data obtained from the distance measuring means 25 and the position detecting means 21.

Since the section between the points "h" and "i" is a straight line, the microcomputer then determines the equation, $y=ax+b$, to be applied to this section, and substitutes the coordinate values of the two points into this equation to obtain $a=a_1$ and $b=b_1$. More specifically, $y=a_1x+b_1$ is determined for the condition of $h<x<i$, and this equation is stored in a memory means in the microcomputer. Further, $x=h$ and $x=i$ are substituted into $y=a_1x+b_1$ to determine the coordinate values of intersections $S_1$ and $T_1$. Further, assuming that the ratio between the slope of the segment (hi) in the graph shown in the upper part of FIG. 2 and the slope of the straight line extending rightward from the point "i" is equal to the ratio between the slope of the segment $T_1S_1$ in the graph shown in the lower part of FIG. 2 and the slope of the straight line extending rightward from the point $S_1$, "$a_1$" is multiplied by this ratio to determine the slope of the straight line extending rightward from the intersection $S_1$. The determination of this slope and the coordinates of the intersection $S_1$ enables determination of the equation, $y=a_2x+b_2$, representing the straight line extending rightward from the intersection $S_1$. Similarly, the equation, $y=a_3x+b_3$, representing the straight line extending leftward from the intersection $T_1$ is determined. Thus, the following equations are determined and stored in the memory means:

$$y=a_3x+b_3(x\leqq h)$$

$$y=a_1x+b_1(h<x<i)$$

$$y=a_2x+b_2(i\leqq x)$$

Accordingly, when "y" (spray distance) is given, it is possible to readily calculate "x" (valve member displacement amount).

Figure 4:
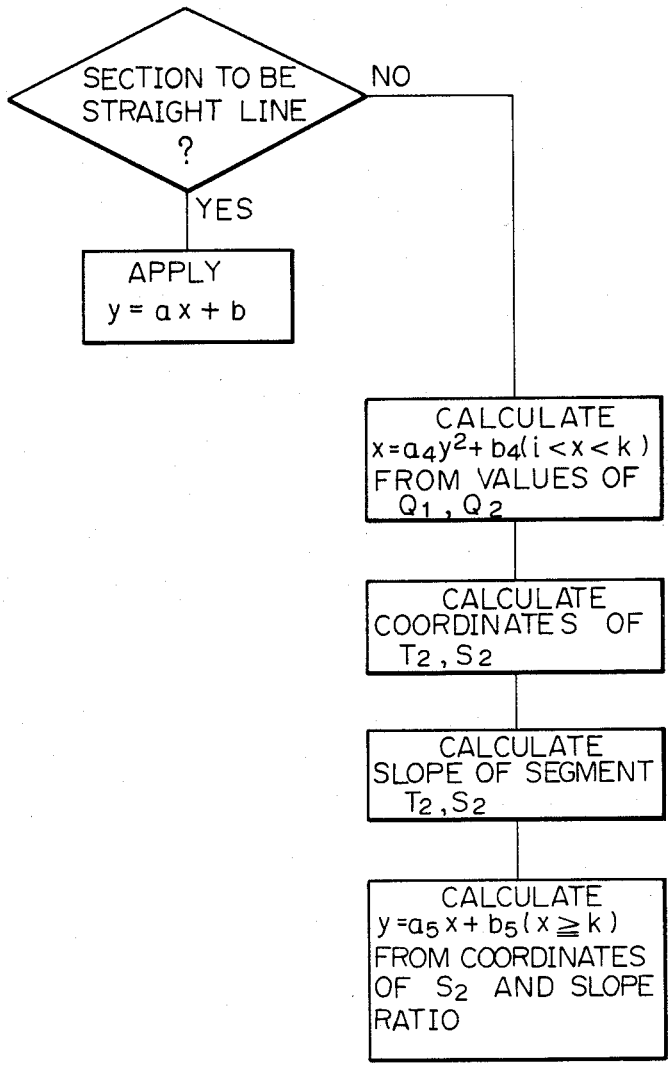
FIG. 4 is a flow chart employed to obtain a similar equation with respect to air.

As to air also, intersections $Q_1$ and $Q_2$ are similarly obtained by trial spraying conducted at 20 cm and 40 cm, and since the segment (jk) in the graph shown in the upper part of FIG. 2 is a parabola, a parabola is also applied to the graph shown in the lower part of FIG. 2, as illustrated in FIG. 4. Then, the respective coordinate values of $Q_1$ and $Q_2$ are substituted into $x=ay^2+b$ to obtain $a=a_4$ and $b=b_4$, from which $x=a_4y^2+b_4$ $(j<x<k)$ is obtained. Then, $x=j$ and $x=k$ are substituted into this equation to obtain the respective coordinate values of $T_2$ and $S_2$, and the slope of the straight line which intersects these points $T_2$ an $S_2$ is calculated (or the slope is calculated from the differentiated value of the center of the curve $T_2S_2$). Then, the equation, $y=a_5x+b_5$, representing the straight line extending rightward from the intersection $S_2$ is calculated from the ratio between the slope thus calculated and the slope ratio obtained in advance. These calculated equations are stored in the memory means.

Since the relationship between the spray distance and the valve member displacement amount can be stored in the form of simple equations of a straight line and a parabola as described above, it is possible to readily calculate a valve member displacement amount for input data concerning a particular spray distance without the need to store complicated data.

It should be noted that hatched portions in the graph shown in the lower part of FIG. 2 represent spray distances outside the limits of a range within which desired painting can be conducted and which is determined experimentally in advance.

The method wherein the relationship between the spray distance and the valve member displacement amount is determined in the manner described above premises that a portion which is a straight line in the first curve is also a straight line in the second curve, and a portion which is a parabola in the first curve is also a parabola in the second curve. The assumption that the two curves show changes of the same degree is made in accordance with experience, and it has been confirmed that it is possible to obtain a uniform coating thickness and spray pattern by actually conducting spraying on the basis of the relationship equations of the spray distance and the valve member displacement amount obtained in the manner disclosed by the present invention.

Although the present invention has been described by way of an example in which both paint and air are jetted out, the present invention may similarly be applicable to a spraying operation in which either paint or air is controlled singly.

Thus, it is possible, according to the present invention, to eliminate the need to employ a complicated program which represents the relationship between the spray distance and the valve member displacement amount, and replace such program with relatively simple functions, i.e., $y=ax+b$ and $x=ay^2+b$. Since an inexpensive IC on the market which enables such functional calculation can be adopted for the microcomputer in the arrangement according to the present invention, it is advantageously possible to reduce the production cost of the spraying apparatus.

Although the present invention has been described through specific terms, it should be noted here that the described embodiment is not necessarily limitative, and various changes and modifications may be imparted thereto without departing from the scope of the invention which is limited solely by the appended claim.

We claim:

1. An automatic spraying method wherein the amount of displacement of a valve member is calculated from data representing a particular spray distance by means of a microcomputer, and the valve member is activated on the basis of the displacement amount thus obtained, said method comprising the steps of:

experimentally obtaining in advance a curve representing the relationship between the valve member displacement amount and the flow rate of a fluid which is to be jetted out;

approximating said curve by a plurality of straight lines or parabolas to define a plurality of sections, obtaining the respective positions of the boundary points of these straight lines or parabolas and the slopes or average slopes thereof, and calculating the ratio between the respective slopes of the sections which are adjacent to each other;

carrying out trial spraying at two different spray distances within a range of valve member displacement amounts included in one section so as to provide a desired coating, and obtaining the relationship between the spray distance and the valve member displacement amount which provides coatings similar to each other at two points; and determining an equation of a straight line or a curve in said section by means of said microcomputer on the basis of data concerning said two points and data which determines said section to be a straight line or a parabola, determining an equation of a straight line or a curve in a section which is adjacent to said section from the equation already obtained and said slope ratio, storing these equations in memory means, and calculating a valve member displacement amount for input data representing a particular spray distance on the basis of said stored equations.

* * * * *